US008890008B2

(12) United States Patent
Lee

(10) Patent No.: US 8,890,008 B2
(45) Date of Patent: Nov. 18, 2014

(54) KEYBOARD

(71) Applicant: Hyung Tae Lee, Seoul (KR)

(72) Inventor: Hyung Tae Lee, Seoul (KR)

(73) Assignees: Wenyu Zhang, Beijing (CN); Leetis Technology Development (HK) Company Limited, Kowloon (HK)

( * ) Notice: Subject to any disclaimer, the term of this patent is extended or adjusted under 35 U.S.C. 154(b) by 114 days.

(21) Appl. No.: 13/727,240

(22) Filed: Dec. 26, 2012

(65) Prior Publication Data

US 2013/0270091 A1 Oct. 17, 2013

(30) Foreign Application Priority Data

Apr. 12, 2012 (KR) ..... 10-2012-0037737

(51) Int. Cl.

| | |
|---|---|
| ***H01H 9/26*** | (2006.01) |
| ***H01H 13/84*** | (2006.01) |
| ***H01H 13/83*** | (2006.01) |
| *H01H 3/12* | (2006.01) |

(52) U.S. Cl.

CPC ..... *H01H 13/84* (2013.01); *H01H 2215/008* (2013.01); *H01H 3/125* (2013.01); *H01H 2205/016* (2013.01); *H01H 2219/016* (2013.01); *H01H 13/83* (2013.01); *H01H 2219/062* (2013.01)

USPC ..... 200/5 A

(58) Field of Classification Search

USPC ..... 200/310–314, 317, 5 A, 512–521, 200/344–345; 362/556, 554, 555, 558, 559, 362/616, 26, 27

See application file for complete search history.

(56) References Cited

U.S. PATENT DOCUMENTS

| | | | | |
|---|---|---|---|---|
| 6,179,432 | B1 * | 1/2001 | Zhang et al. | 362/84 |
| 6,987,466 | B1 * | 1/2006 | Welch et al. | 341/22 |
| 8,319,128 | B2 * | 11/2012 | Bronstein et al. | 200/314 |
| 2003/0103359 | A1 * | 6/2003 | Chiang et al. | 362/558 |
| 2014/0034472 | A1 * | 2/2014 | Krumpelman et al. | 200/5 A |

* cited by examiner

*Primary Examiner* — Edwin A. Leon
(74) *Attorney, Agent, or Firm* — Anova Law Group, PLLC

(57) ABSTRACT

An exemplary keyboard includes a keyboard shell; a supporting panel arranged to the keyboard shell and having a plurality of elastomer holes therein; a plurality of keycaps arranged on the corresponding elastomer holes; a plurality of keycap supports between the supporting panel and the corresponding keycaps; a plurality of elastomers through the corresponding elastomer holes and being exposed out of the supporting panel; light emitting members arranged on the light emitting substrate and corresponding to each of the keycap; and an FPC sheet arranged between the light emitting substrate and the supporting panel, the FPC sheet comprising a key signal pads corresponding to each of the elastomer holes; light emitting substrate arranged under the supporting panel; the cross-section area of the elastomer hole is greater than that of the elastomer.

9 Claims, 10 Drawing Sheets

KEYBOARD

FIELD OF THE INVENTION

The present disclosure relates to the art of keyboards and, particularly to a keyboard having backlight which illuminates light from the bottom of the keycap.

DESCRIPTION OF RELATED ART

Keyboards usually are used for inputting signals to computers by tapping key bodies. Herein in this invention keyboard is an inputting device used for computer, portable computer and other devices having signals inputting.

Recently, a keyboard that can be used in dim with accurate operations and having light beams irradiated from undersides of the keycaps to the keycaps has been disclosed.

FIG. 10 is an exploded view of a conventional keyboard. FIG. 11 is a cross-sectional view of part of the conventional keyboard of FIG. 10. FIG. 12 is a cross-sectional view of an FPC sheet of the conventional keyboard of FIG. 10.

The conventional keyboard as shown in FIGS. 10~12, includes a keyboard shell 111, a supporting panel 112 integrated with the keyboard shell 111 and having a plurality of elastomer holes 112*a* therein, a plurality of keycaps 113 arranged on the elastomer holes 112*a*, a plurality of keycap supports 130 against the supporting panel 112 for supporting the keycap 113, an elastomer panel 150 arranged under the supporting panel 112, a flexible printed circuit (FPC) sheet 160 arranged under the elastomer panel 150, a light defusing panel 117 under the FPC sheet 160, a light emitting part 140 with a light emitting substrate 141 arranged under the light defusing panel 117, a main board (not shown) electrically connecting the FPC sheet 160 and the light emitting part 140, and a rear panel 118 arranged under the light emitting substrate 141.

The keyboard shell 111 with the above described structure can be made of material of metal or metal alloy, such as aluminum, or can be made of material of hard synthetic resin.

The supporting panel 112 has an upper part penetrating an upper part of the keyboard shell 111 and exposed. The supporting panel 112 and the keyboard shell 111 are connected as a piece of one part.

The keycap support 130 is constituted with an up-down guide portion 131 formed in an underside of the keycap 113, a pressure portion 132 formed inside of the up-down guide portion 131 and a guide rail 133 formed within a scope of a perimeter of a flexible through hole 112*a* of the supporting panel 112.

The up-down guide portion 131 has a protrusion 131*a* in a bottom end thereof. The pressure portion 132 has its bottom end contacting with a top end of a elastomer 151. The guide rail 133 has a limit corner 133*a* in its upper part.

The protrusion 131*a* and the limit corner 133*a* can be buckled with each other.

The keycap support 130 has such a configuration that the keycap 113 is closed to the supporting panel 112 when pressed down the keycap 113.

The elastomer panel 150 has elastomers 151 corresponding to the elastomer holes 112*a*. The elastomer 151 is arch shaped overall, and a pressure protrusion 151*a* is formed inside.

The elastomer 151 with the above described structure can be made of rubber or other elastic and transparent materials.

The FPC sheet 160 includes a middle insulative layer 162, an upper layer 161 and a lower layer 163 arranged at the two sides of the insulative layer 162 respectively, and outer connecting pads 164 electrically connecting the upper layer 161 and the lower layer 163.

Connecting holes 162*a* corresponding to the elastomer holes 112*a* are arranged in the insulative layer 162.

Upper key signal pads 161*a* are formed on the upper layer 161, and lower key signal pads 163*a* are formed on the lower layer 163 respectively which have the same configuration as the elastomer holes 112*a*.

The outer connecting pads 164 are electrically connected to the upper key signal pads 161*a*, lower key signal pads 163*a*, and the main board (not shown).

With the above described structure, when the elastomer 151 is pressed by the keycap 113, as described later, a pressure enhancing protrusion 151*a* provides pressure to the upper key signal pad 161*a*, then the upper key signal pad 161*a* passes through the corresponding connecting hole 162*a* and connects to the lower key signal pad 163*a*.

When the upper key signal pad 161*a* is connected to the lower key signal pad 163*a*, the key signal is in ON state. When the pressure is released from the keycap 113, the upper key signal pad 161*a* is separated from the lower key signal pad 163*a*, then the key signal is in OFF state.

The ON state and the OFF state of the upper key signal pad 161*a* and the lower key signal pad 163*a* are sent to a computer through the outer connecting pads 164 and the main board (not shown).

A arch-shaped lens 117*a* formed on the light defusing panel 117 is arranged under the elastomer 151. The Light emitting part 140 includes a light emitting substrate 141 and some light emitting members 142 arranged on the light emitting substrate 141.

The light emitting substrate 141 is preferably selected from ceramic PCB and such high-temperature substrates.

The light emitting substrate 141 is electrically connected to the main board (not shown).

Light emitting driver chips are arranged on the light emitting substrate 141. The light emitting driver chips receive light emitting control signals from the computer or keyboard MCU IC via the main board (not shown), and drive the light emitting members 142 to emit light beams.

The light emitting members 142 can be light emitting diodes (LEDs).

The light emitting members 142 with the above described structure is arranged on the light emitting substrate 141, and are under the arch-shaped lens 117*a*.

Light beams emitted from the light emitting members 142 through the arch-shaped lens 117*a* and the elastomer 151, and reach the upper side of the supporting panel 112.

The driving voltage of the light emitting member 142 is from a battery disposed on the keyboard shell 111 or from the main body of a computer.

The main board (not shown) is electrically connected to the computer via electric codes.

The rear panel 118 is bounded onto the keyboard shell 111 with some screws or other integration process.

In the following, the assembling method of the above-described keyboard will be disclosed.

Firstly, the keycaps 113 are installed. The keycap support 130 is supported on the supporting panel 112.

Finally, when the elastomer panel 150, the FPC sheet 160, the defusing panel 117, and the light emitting substrate 141 are installed between the keyboard shell 111 and the rear panel 118, the rear panel 118 is fastened to the keyboard shell 111 by screws or other integration process.

The above described keyboard is disclosed in Korean patent with patent application number 54613 (named as keyboard).

However, the elastomer 151 are formed on the elastomer panel 150. The FPC sheet 160 includes insulative layer 162, the upper layer 161 and the lower layer 162. This increases the total thickness of the keyboard and is not convenient for the user.

Therefore, it is desirable to provide a keyboard which can overcome the above-mentioned problem.

SUMMARY

This invention discloses a keyboard with decreased thickness.

An exemplary keyboard includes a keyboard shell; a supporting panel arranged to the keyboard shell and having a plurality of elastomer holes therein; a plurality of keycaps arranged on the corresponding elastomer holes; a plurality of keycap supports between the supporting panel and the corresponding keycaps; a plurality of elastomers through the corresponding elastomer holes and being exposed out of the supporting panel; light emitting members arranged on the light emitting substrate and corresponding to each of the keycap; and an FPC sheet arranged between the light emitting substrate and the supporting panel, the FPC sheet comprising a key signal pads corresponding to each of the elastomer holes; light emitting substrate arranged under the FPC sheet; the cross-section area of the elastomer hole is greater than that of the elastomer; the elastomer comprises a top part, an elastic supporting part which extends from the top part and defines a pressure enhancing protrusion under the top part, and a conductive layer arranged on the bottom surface of the pressure enhancing protrusion; the pressure enhancing protrusion is opposite to the key signal pad, when pressure is applied on the keycap, the pressure enhancing protrusion is forced to reach the key signal pad with conductive layer electrically connected to the key signal pad, the pressure enhancing protrusion is supported on the FPC sheet by the elastic supporting part; the light emitting members are arranged on the light emitting substrate, and the light beams from the light emitting members cross the elastomer holes and reach the upper side of the supporting panel.

Furthermore, the keycap support has a cross structure, the top of the keycap support is jointed to the keycap, and the bottom of the keycap support is jointed to the supporting panel, the keycap support has a scissors-like structure.

Furthermore, the elastomer is made of elastic transparent material.

Furthermore, the keyboard shell is made of material of metal or metal alloy or hard synthetic resin.

Furthermore, the FPC sheet has a one-layered structure with key signal pads thereon corresponding to the elastomer holes. The conductive layer is arranged under the bottom of the elastomer. When the pressure enhancing protrusion is pressed the conductive layer is electrically connected to the key signal pad on the FPC sheet, thereby making an ON state signal. Such one-layer structure makes the whole thickness of the keyboard is reduced.

DETAILED DESCRIPTION

Reference will now be made to describe an exemplary embodiment of the present disclosure in detail.

Figure 1:
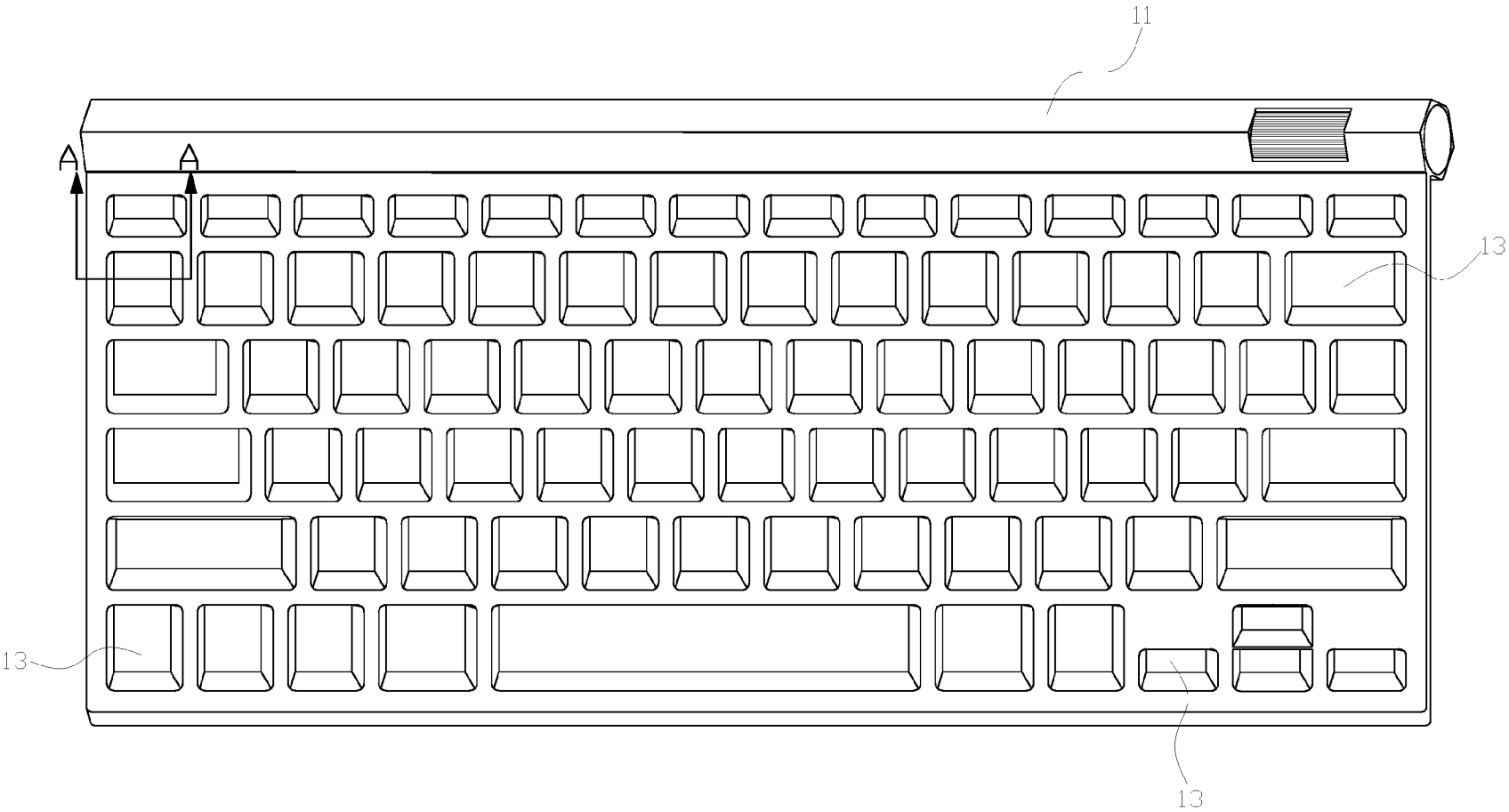
FIG. 1 is an illustrative view of a keyboard in accordance with an exemplary embodiment of the present invention.
Figure 2:
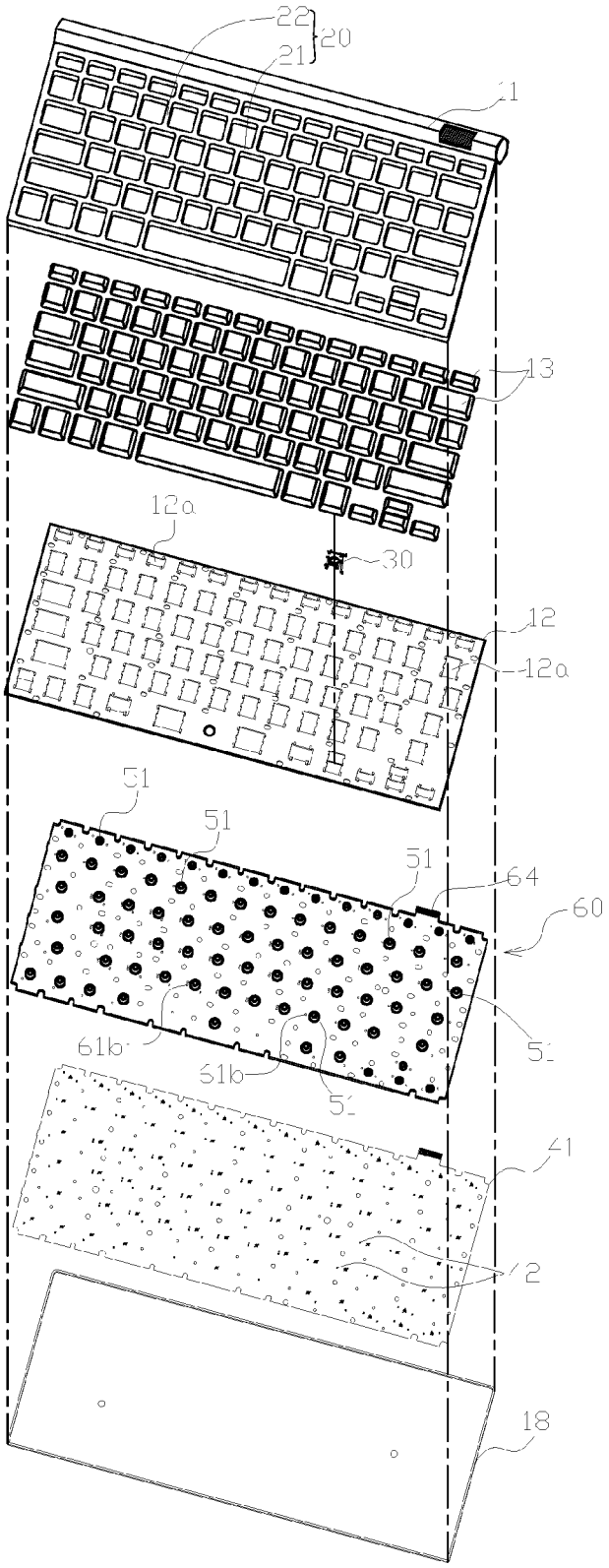
FIG. 2 is an exploded view of the keyboard in accordance with an exemplary embodiment of the present invention.
Figure 3:
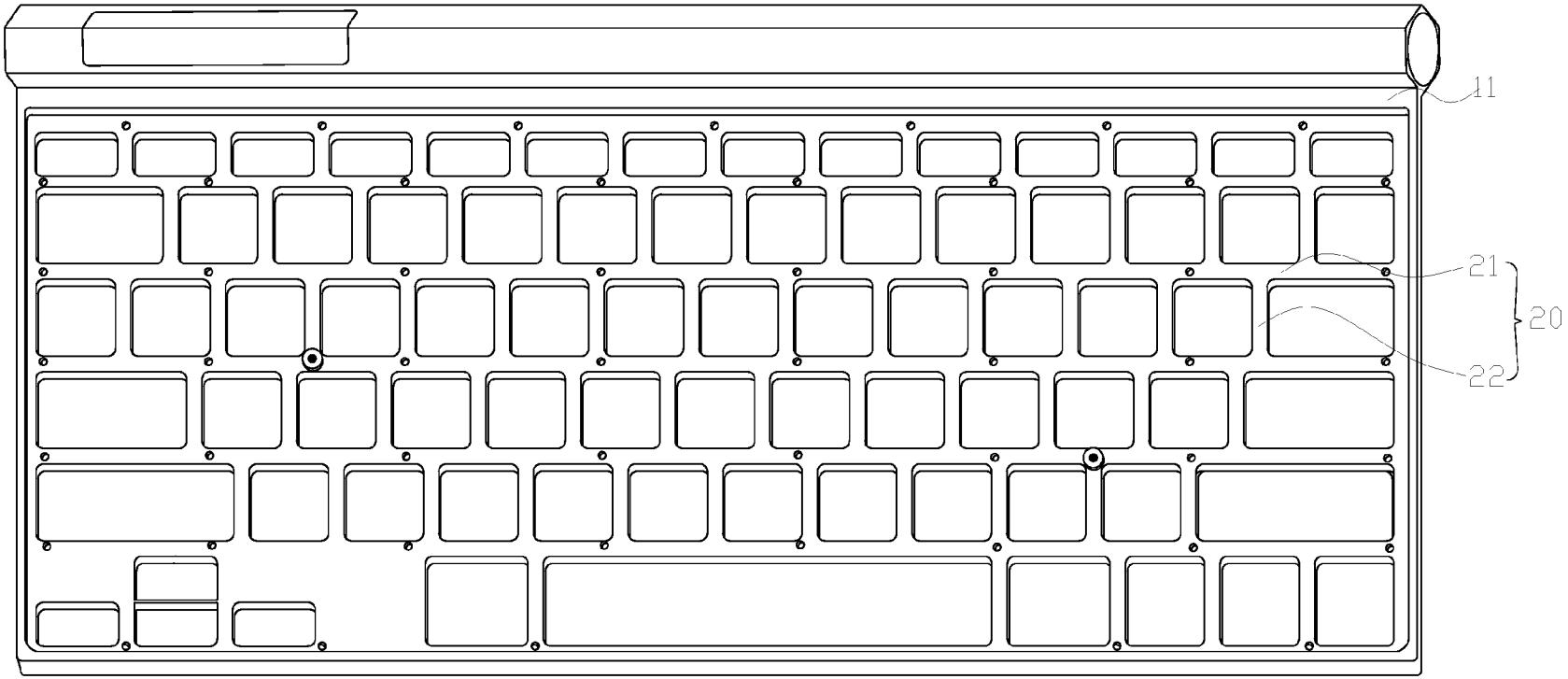
FIG. 3 is an illustrative back view of a keyboard shell of the keyboard of FIG. 2.
Figure 4:
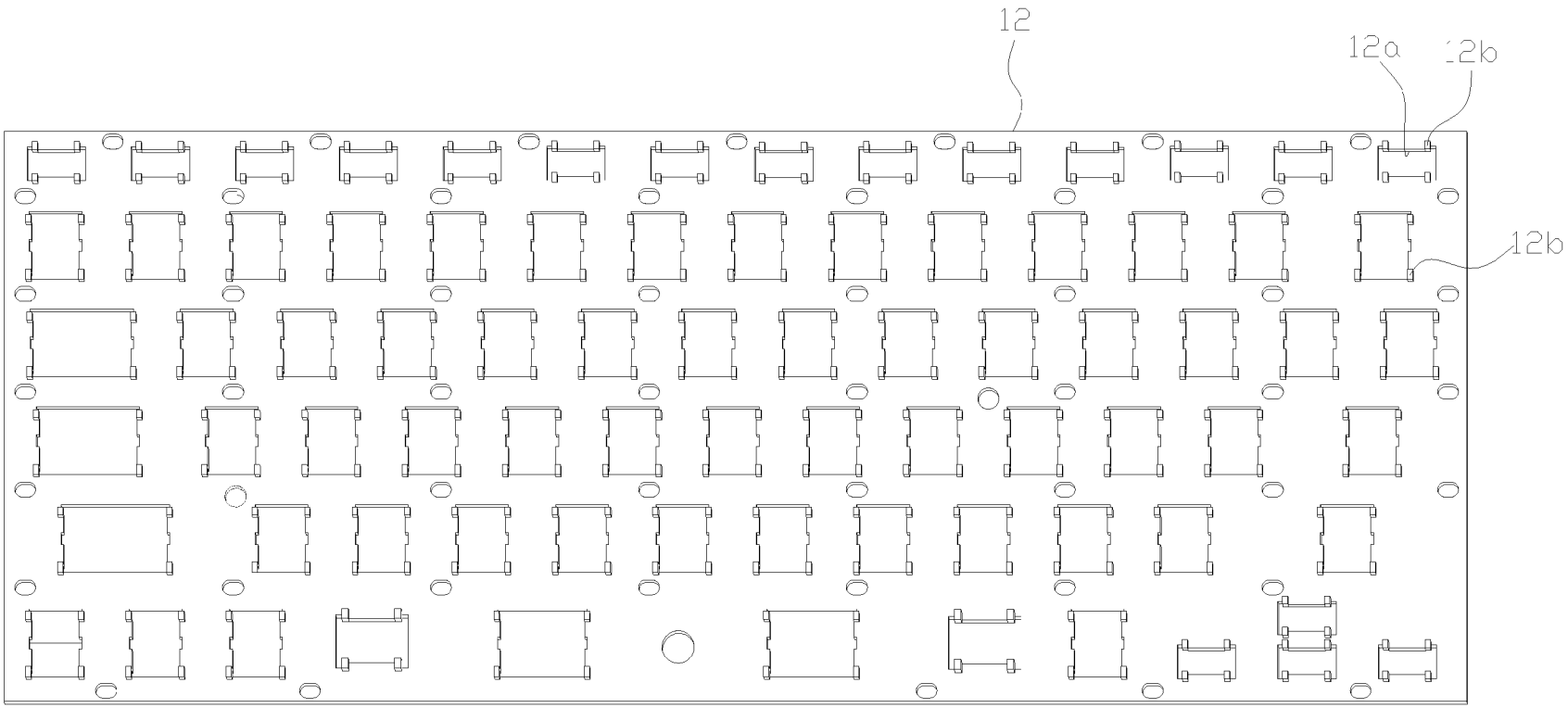
FIG. 4 is an illustrative view of a supporting panel of the keyboard of FIG. 2.
Figure 5:
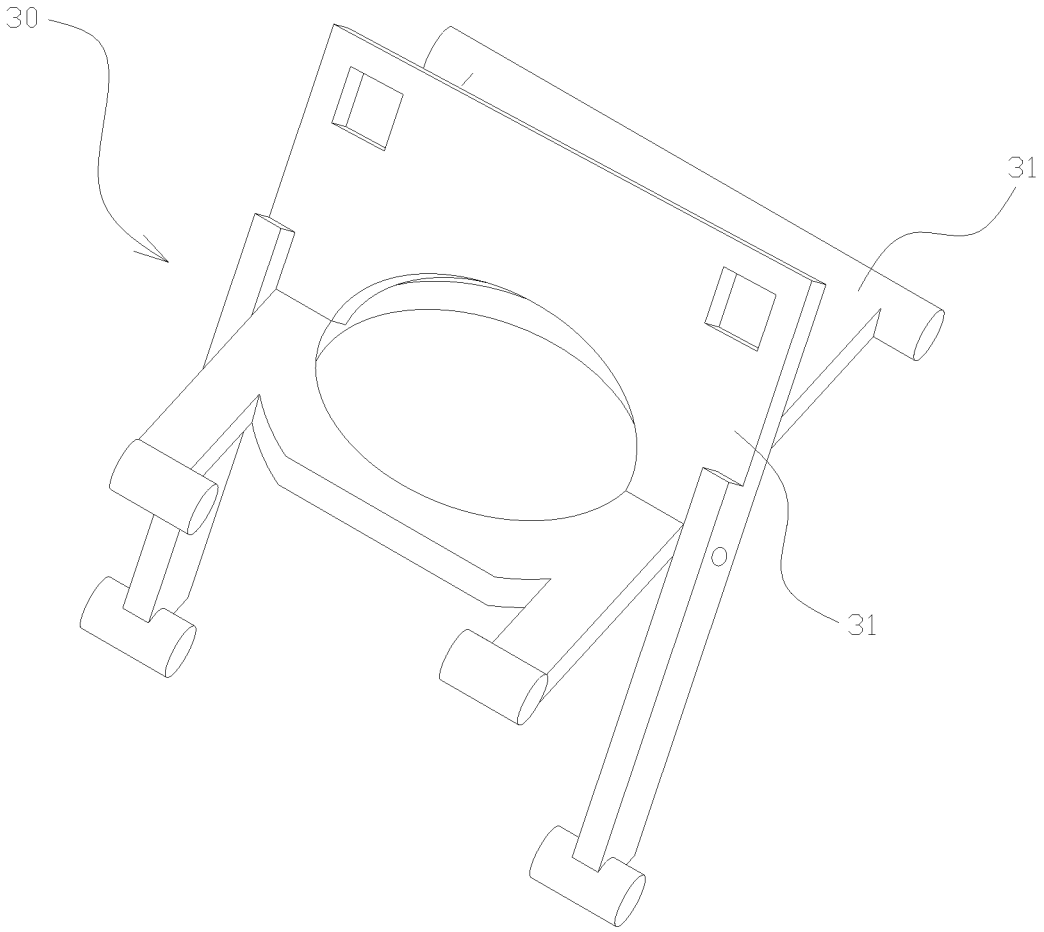
FIG. 5 is an illustrative view of a keycap support of the keyboard of FIG. 2.
Figure 6:
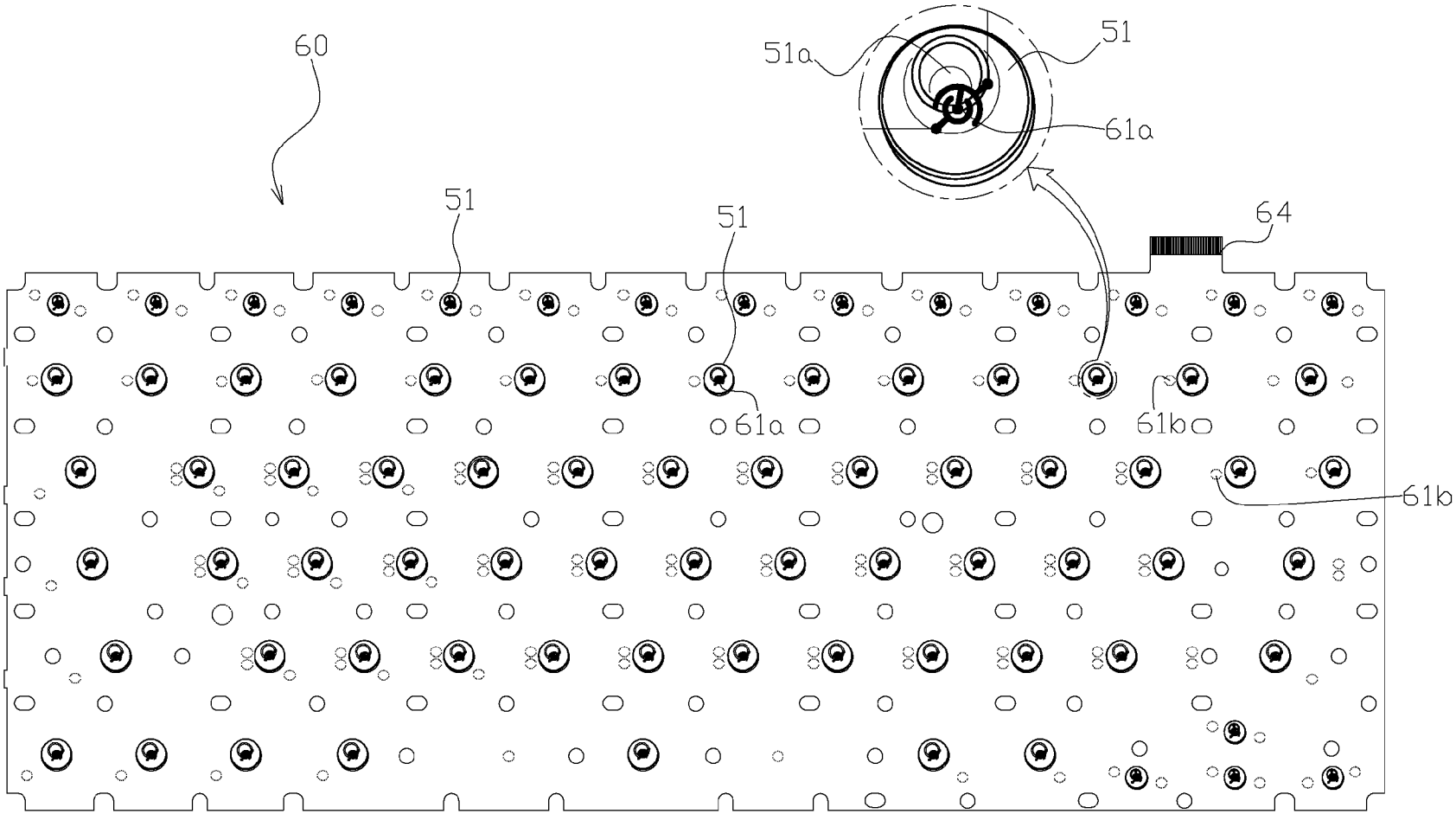
FIG. 6 is an illustrative view of an FPC sheet of the keyboard of FIG. 2.
Figure 7:
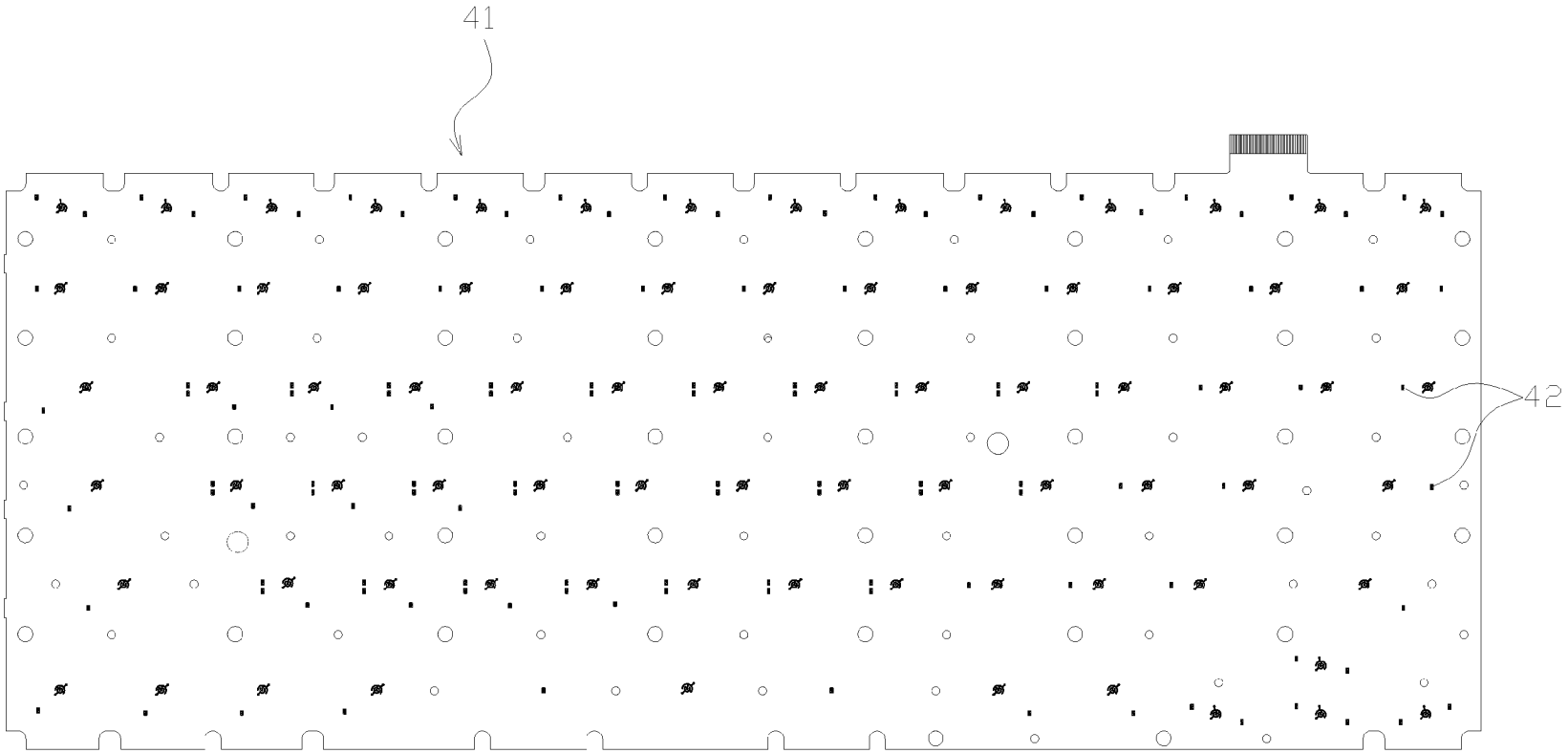
FIG. 7 is an illustrative view of an FPC sheet of the keyboard of FIG. 2.
Figure 8:
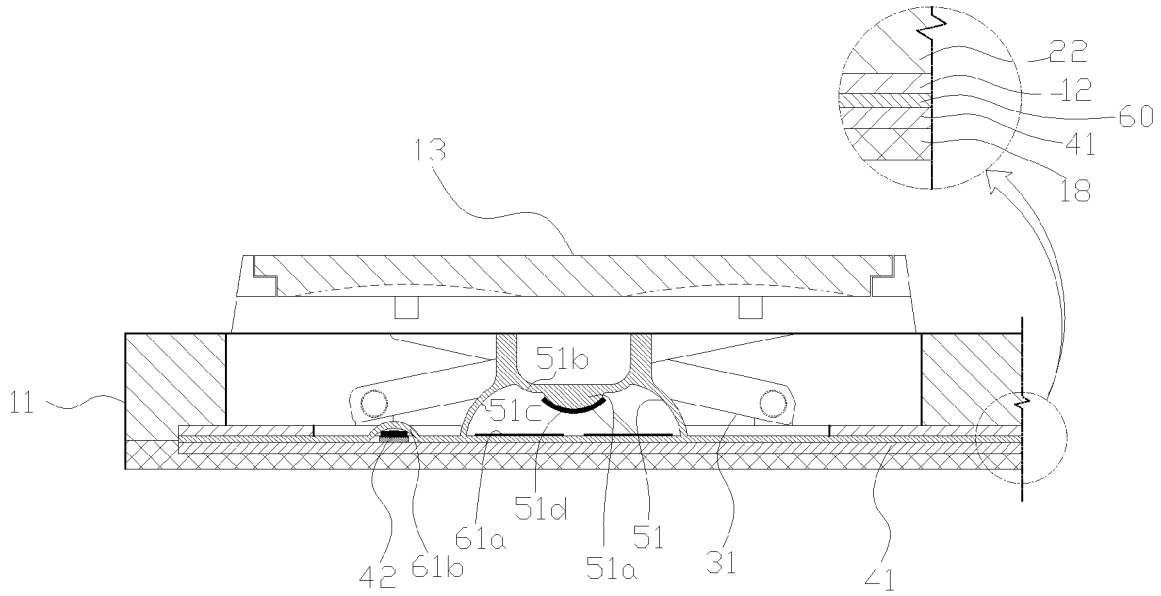
FIG. 8 is an enlarged cross-sectional view of the keyboard along line A-A in FIG. 1.
Figure 9:
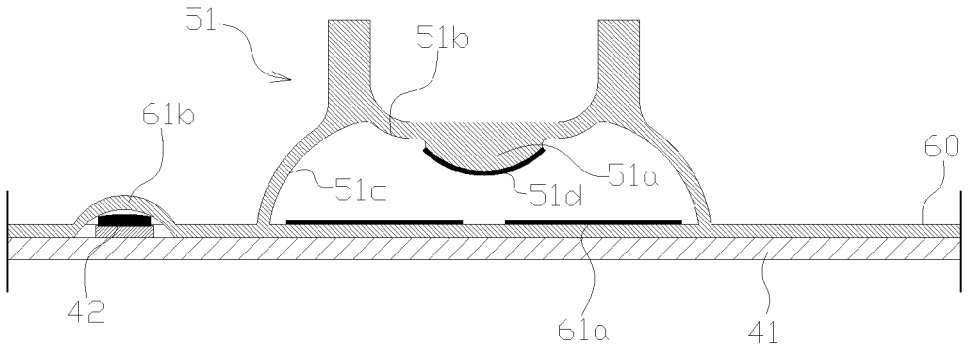
FIG. 9 is an illustrative view of an assembly of the light emitting substrate, the FPC sheet, the supporting panel, and the elastomers in accordance with an exemplary embodiment of the present invention.
Figure 10:
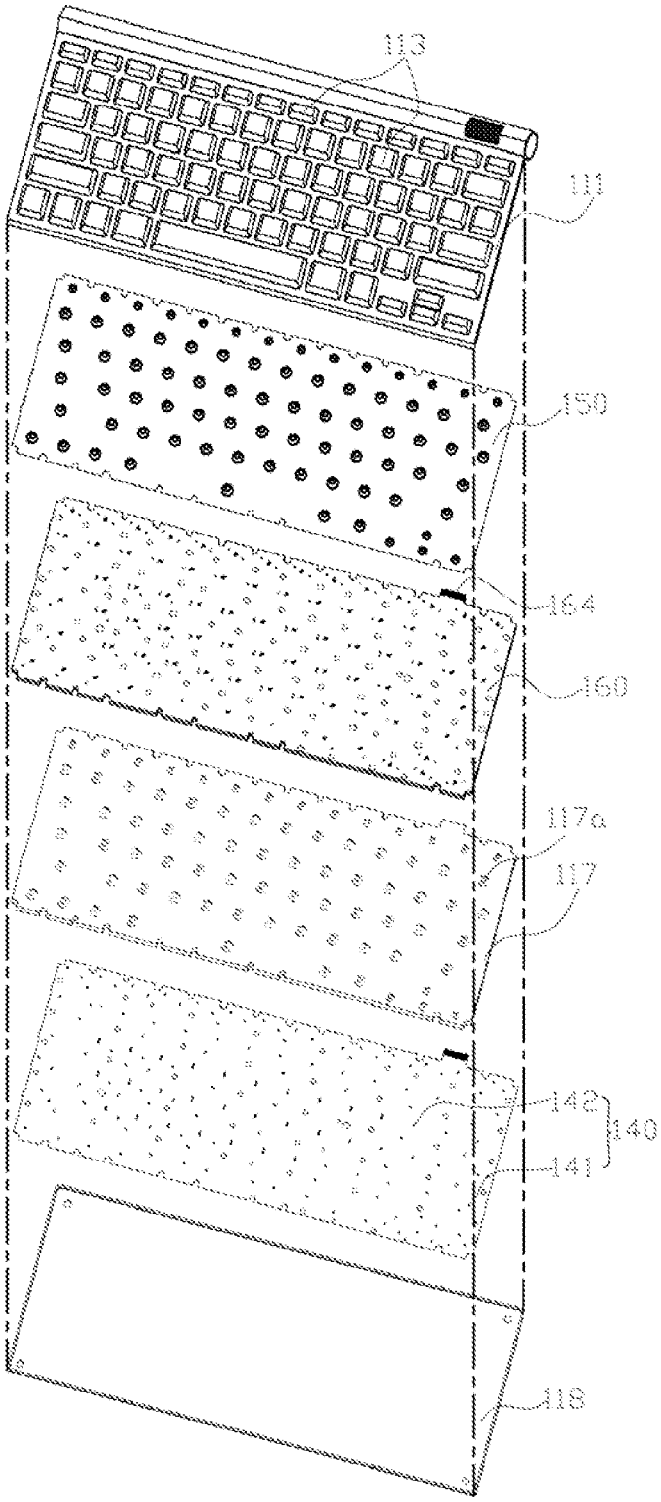
FIG. 10 (Prior Art)
FIG. 10 is an exploded view of a conventional keyboard.
Figure 11:
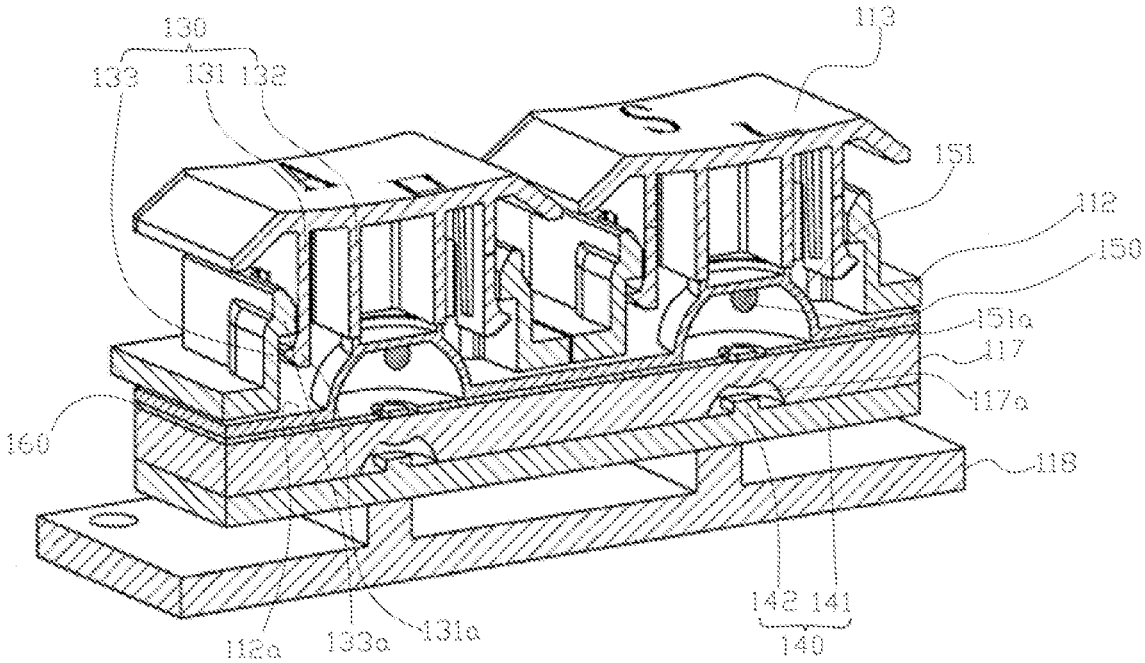
FIG. 11 (Prior Art)
FIG. 11 is a cross-sectional view of part of the conventional keyboard of FIG. 10.
Figure 12:
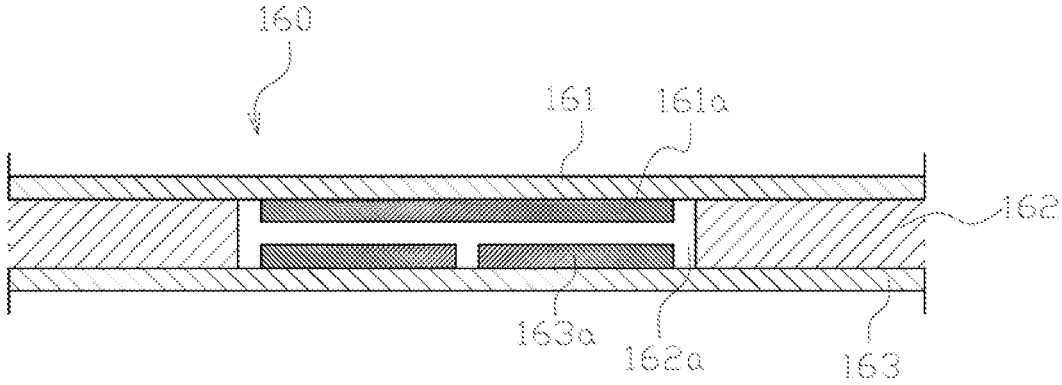
FIG. 12 (Prior Art)
FIG. 12 is a cross-sectional view of an FPC sheet of the conventional keyboard of FIG. 10.

FIG. 1 is an illustrative view of a keyboard in accordance with an exemplary embodiment of the present invention; FIG. 2 is an exploded view of the keyboard in accordance with an exemplary embodiment of the present invention; FIG. 3 is an illustrative back view of a keyboard shell of the keyboard of FIG. 2; FIG. 4 is an illustrative view of a supporting panel of the keyboard of FIG. 2; FIG. 5 is an illustrative view of a keycap support of the keyboard of FIG. 2; FIG. 6 is an illustrative view of an FPC sheet of the keyboard of FIG. 2; FIG. 7 is an illustrative view of an FPC sheet of the keyboard of FIG. 2; FIG. 8 is an enlarged cross-sectional view of the keyboard along line A-A in FIG. 1; FIG. 9 is an illustrative view of an assembly of the light emitting substrate, the FPC sheet, the supporting panel, and the elastomers in accordance with an exemplary embodiment of the present invention.

The key board of the present invention as illustrated in the FIGS. 1-9, includes a keyboard shell 11, a supporting platform 20 formed on the keyboard shell 11, a supporting panel 12 arranged to the keyboard shell 11 with a plurality of elastomer holes 12*a*, a plurality of keycaps 13 arranged on the elastomer holes 12*a*, a plurality of keycap supports 30 against the supporting panel 12 for connecting the keycap 13, a flexible printed circuit (FPC) sheet 60 arranged under the supporting panel 12, a plurality of elastomers 51 arranged on the FPC sheet 60, a light emitting substrate 41 arranged under the FPC sheet 60, a plurality of light emitting members 42 arranged on the light emitting substrate 41, a main board (not shown) electrically connecting the light emitting substrate 41 and the FPC sheet 60, and a rear panel 18 arranged under the light emitting substrate 41.

The keyboard shell 11 with the above described structure can be made of material of metal or metal alloy, such as aluminum, or can be made of material of hard synthetic resin.

The supporting platform 20 includes a plurality of horizontal parts 21 and a plurality of vertical parts 22 connected with each other, thereby forming a plurality of grids arranged in matrix. The grids formed by the horizontal parts 21 and the vertical parts 22 do not interfere the elastomers 51 and the keycap supports 30.

Four supporting protrusions 12*b* around each elastomer hole 12*a* are formed on the supporting panel 12.

A cross-sectional area of the elastomer holes 12*a* is greater than that of the elastomers 51. The space between the elastomer holes 12*a* and the elastomer 51 define a plurality of light through area.

The keycap support 30 has a cross structure. The top of the keycap support 30 is jointed to the keycap 13, and the bottom of the keycap support 30 is jointed to the connecting parts 31 of the four supporting protrusions 12*b*. The keycap support 30 has a scissors-like structure.

The keycap support 30 can be any of the conventional key cap support, and the detailed structure of the keycap support 30 is omitted.

With the above described structure, when the keycap 13 is pushed down, the keycap 13 is close to the top of the supporting panel 12.

Besides of the scissors-like structure, the keycap support 30 can also be any other structure, such as the mechanic keycap support with a guiding slide.

The FPC sheet 60 includes a key signal pads layer with key signal pads 61*a* corresponding to the elastomer holes 12*a*.

The parts of the FPC sheet 60 which correspond to the light emitting members 42 bend upward are defined as light emitting member houses 61*b*.

The FPC sheet 60 with the above described structure is arranged under the supporting panel 12, making the key signal pads 61*a* and the elastomer holes 12*a* opposite to each other.

The outer connecting pads 64 of the FPC sheet 60 are electrically connected to the key signal pads 61*a* and the main board (not shown).

The FPC sheet 60 is water resistant.

The elastomers 51 can be made of rubber or other elastic or transparent materials. In this invention, the semitransparent material is also included.

The elastomer 51 includes a top part 51*b*, an elastic supporting part 51*c* which extends from the top part 51*b* and defines a pressure enhancing protrusion 51*a* under the top part 51*b*. A conductive layer 51*d* is arranged on the surface of the pressure enhancing protrusion 51*a*.

The elastomer 51 with the above described structure is arranged on the FPC sheet 60. When the elastomer 51 is pressed by the keycap 13 with pressure towards the key signal pad 61*a*, the conductive layer 51*d* is pressed to contact the lower key signal pad 61*a* through the corresponding elastomer hole 12*a*. The elastomer 51 extends out of the elastomer hole 12*a*. The elastomer 51 with the above described structure is adhered on the FPC sheet 60 or integrated on the FPC sheet 60 via adhesive material.

When pressure is applied on the keycap 13 and the conductive layer 51*d* is connected to the key signal pad 61*a*, the key signal is in ON state.

When the pressure is released from the keycap 13, the conductive layer 51*d* is separated from the key signal pad 61*a*, and then the key signal is in OFF state.

The ON state and OFF state signals are transmitted to the computer through the outer connecting pads 64 and the main board (not shown).

Light emitting substrate 41 is electrically connected with the main board (not shown).

Light emitting driver chips (not shown) are arranged on the light emitting substrate 41. The light emitting driver chips receive light emitting control signals from the computer or a keyboard MCU IC, and drive the light emitting members 42 to emit light beams.

The light emitting substrate 41 is preferably selected from metal PCB, ceramic PCB and such high-temperature substrates, and flexible printed board (FPC).

The light emitting members 42 are arranged on the light emitting substrate 41, and are received in emitting member houses 61*b*. Thus when the light emitting member 42 emits light, the light beams can go through the elastomer hole 12*a*, and reach the upper side of the supporting panel 12 (the FPC sheet 60 is made of transparent material).

The light emitting members 42 can be light emitting diodes (LEDs).

The driving voltage of the light emitting member 42 is from a battery disposed on the keyboard shell 11 or from a computer.

The main board (not shown) can be electrically or wirelessly connected to a computer through communication codes.

The rear panel 18 has a caved fixing portion and can be fastened with the keyboard shell using screws and other mechanical integration process.

The process of assembling the keyboard with above described structure is described as follows.

First of all, the keycap supports 30 are arranged on the supporting panel 12. Then the keycaps 13 are arranged on the keycap supports 30. Then the light emitting substrate 41 and the FPC sheet 60 are combined together. Thereafter the light emitting substrate 41 and the FPC sheet 60 are screwed on the supporting panel 12. Finally, the supporting panel 12, the light emitting substrate 41, and the FPC sheet 60 are arranged between the keyboard shell 11 and the rear panel 18 by using screws and other mechanical integration process.

As the described embodiment of the invention, in order to make through the light beams of the light emitting members 42 to reach keycap, the cross-section area of the elastomer hole 12*a* is greater than that of the elastomer 51. Because the elastomer is made of transparent material, light beams from the light emitting members 42 can go through the elastomer 51, and reach the upper side of the supporting panel 12. In this invention, the elastomer 51 can also be made of semitransparent material.

Moreover, the FPC sheet 60 has a one-layered structure with key signal pads 61*a* thereon corresponding to the elastomer holes 12*a*. Conductive layer 51*d* is arranged under the bottom of the elastomer 51. When the pressure enhancing protrusion 51*a* is pressed, the conductive layer 51*d* is electrically connected to the key signal pad 61*a* on the FPC sheet 60, thereby making an ON state signal. Such one-layer structure makes the whole thickness of the keyboard is reduced.

It will be understood that the above particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A keyboard comprising:

a keyboard shell;

a supporting panel arranged to the keyboard shell and having a plurality of elastomer holes therein;

a plurality of keycaps arranged on the corresponding elastomer holes;

a plurality of keycap supports between the supporting panel and the corresponding keycaps;

a plurality of elastomers through the corresponding elastomer holes and being exposed out of the supporting panel;

light emitting members arranged on the light emitting substrate and corresponding to each of the keycap; and an FPC sheet arranged between the light emitting substrate and the supporting panel, the FPC sheet comprising a key signal pads corresponding to each of the elastomer holes;

the light emitting substrate arranged under the FPC sheet;

the cross-section area of the elastomer hole is greater than that of the elastomer;

the elastomer comprises a top part, an elastic supporting part which extends from the top part and defines a pressure enhancing protrusion under the top part, and a conductive layer arranged on the bottom surface of the pressure enhancing protrusion;

the pressure enhancing protrusion is opposite to the key signal pad, when pressure is applied on the keycap, the pressure enhancing protrusion is forced to reach the key signal pad with conductive layer and electrically connected to the key signal pad, the pressure enhancing protrusion is supported on the FPC sheet by the elastic supporting part;

the light emitting members are arranged on the light emitting substrate, and the light beams from the light emitting members go through the elastomer holes and reach the upper side of the supporting panel.

2. The keyboard as claimed in claim 1, wherein the keycap support has a cross structure, the top of the keycap support is jointed to the keycap, and the bottom of the keycap support is jointed to the supporting panel, the keycap support has a scissors-like structure.

3. The keyboard as claimed in claim 1, wherein the light emitting substrate is selected from metal PCB, ceramic PCB, and FPC.

4. The keyboard as claimed in claim 1, the elastomer is made of elastic transparent material.

5. The keyboard as claimed in claim 1, wherein the keyboard shell is made of material of metal or metal alloy or hard synthetic resin.

6. A keyboard comprising:

a keyboard shell;

a supporting panel arranged to the keyboard shell and having a plurality of elastomer holes therein;

a plurality of keycaps arranged on the corresponding elastomer holes;

a plurality of keycap supports between the supporting panel and the corresponding keycaps;

a plurality of elastomers through the corresponding elastomer holes and being exposed out of the supporting panel;

light emitting members arranged on the light emitting substrate and corresponding to each of the keycap; and an FPC sheet arranged between the light emitting substrate and the supporting panel, the light emitting substrate arranged under the FPC sheet;

the FPC sheet comprising a key signal pads corresponding to each of the elastomer holes;

the elastomer is made of transparent material and comprises a top part, an elastic supporting part which extends from the top part and defines a pressure enhancing protrusion under the top part, and a conductive layer arranged on the bottom surface of the pressure enhancing protrusion;

the pressure enhancing protrusion is opposite to the key signal pad, when pressure is applied on the keycap, the pressure enhancing protrusion is forced to reach the key signal pad with conductive layer and electrically connected to the key signal pad, the pressure enhancing protrusion is supported on the FPC sheet by the elastic supporting part;

the light emitting members are arranged on the light emitting substrate, and the light beams from the light emitting members go through the elastomer holes and reach the upper side of the supporting panel.

7. The keyboard as claimed in claim 6, wherein the keycap support has a cross structure, the top of the keycap support is jointed to the keycap, and the bottom of the keycap support is jointed to the supporting panel, the keycap support has a scissors-like structure.

8. The keyboard as claimed in claim 6, wherein the light emitting substrate is selected from metal PCB, ceramic PCB, and FPC.

9. The keyboard as claimed in claim 6, wherein the keyboard shell is made of material of metal or metal alloy or hard synthetic resin.

* * * * *